US009943873B1

(12) United States Patent
Teng

(10) Patent No.: US 9,943,873 B1
(45) Date of Patent: Apr. 17, 2018

(54) ATOMIZING PLUG ASSEMBLY AND ATOMIZER FORMED THEREBY

(71) Applicant: Taiwan Puritic Corp., Hsinchu County (TW)

(72) Inventor: Huan-Ping Teng, Hsinchu County (TW)

(73) Assignee: Taiwan Puritic Corp., Hukou Township, Hsinchu County (TW)

( * ) Notice: Subject to any disclaimer, the term of this patent is extended or adjusted under 35 U.S.C. 154(b) by 0 days.

(21) Appl. No.: 15/835,120

(22) Filed: Dec. 7, 2017

Related U.S. Application Data

(63) Continuation-in-part of application No. 14/529,987, filed on Oct. 31, 2014.

(30) Foreign Application Priority Data

Jun. 20, 2014 (TW) ..... 103210921 A

(51) Int. Cl.

| | |
|---|---|
| ***B05B 1/08*** | (2006.01) |
| ***B05B 17/00*** | (2006.01) |
| ***B05B 17/06*** | (2006.01) |
| ***B05B 7/24*** | (2006.01) |
| ***B05B 1/14*** | (2006.01) |

(52) U.S. Cl.
CPC ..... *B05B 17/0646* (2013.01); *B05B 1/14* (2013.01); *B05B 7/2408* (2013.01); *B05B 17/06* (2013.01); *B05B 17/0638* (2013.01); *B05B 17/0653* (2013.01)

(58) Field of Classification Search
CPC ..... B05B 17/0646; B05B 17/0638; B05B 17/0653; B05B 17/06; B05B 7/2408; B05B 1/14; B05B 1/02; A61M 15/0085
USPC .... 239/102.2, 302, 379, 552, 596, 600, 601; 128/200.14, 200.16
See application file for complete search history.

(56) References Cited

U.S. PATENT DOCUMENTS

| | | | | |
|---|---|---|---|---|
| 4,533,082 | A | 8/1985 | Maehara et al. | |
| 4,793,339 | A * | 12/1988 | Matsumoto | B05B 17/0623 128/200.16 |
| 5,758,637 | A * | 6/1998 | Ivri | A61M 11/005 239/102.2 |
| 6,805,393 | B1 | 10/2004 | Stevenson et al. | |
| 7,607,589 | B2 | 10/2009 | Yu et al. | |
| 7,784,712 | B2 | 8/2010 | Wang et al. | |

(Continued)

*Primary Examiner* — Steven J Ganey
(74) *Attorney, Agent, or Firm* — Muncy, Geissler, Olds & Lowe, P.C.

(57) ABSTRACT

The invention relates to an atomizing plug assembly and an atomizer formed thereby. The atomizing plug assembly comprises a containing part and an atomizing part. The containing part has a containing body. The containing body defines a containing space for containing a liquid to be atomized and has an aerosol opening which communicates with the containing space. The atomizing part is integrated with or detachably connected with the containing part and has a vibrating member and a nozzle plate. The vibrating member has an atomizing electrical connecting portion, where the vibrating member is electrically connected, and a pin element electrically connected with the atomizing electrical connecting portion. The nozzle plate is located corresponding to the aerosol opening. The atomizer is formed by electrically connecting the atomizing plug assembly to a base.

11 Claims, 6 Drawing Sheets

(56) References Cited

U.S. PATENT DOCUMENTS

| | | | |
|---|---|---|---|
| 7,954,730 | B2 | 6/2011 | Ng |
| 2005/0011514 | A1 | 1/2005 | Power et al. |
| 2009/0308945 | A1 | 12/2009 | Loverich et al. |
| 2010/0326431 | A1 | 12/2010 | Yu |

* cited by examiner

ATOMIZING PLUG ASSEMBLY AND ATOMIZER FORMED THEREBY

CROSS-REFERENCE TO RELATED APPLICATION

This application is a continuation-in-part of co-pending application Ser. No. 14/529,987, filed on Oct. 31, 2014, for which priority is claimed under 35 U.S.C. § 120; and this application claims priority of Application No. 103210921 filed in Taiwan on Jun. 20, 2017 under 35 U.S.C. § 119; and, the entire contents of all of which are hereby incorporated by reference.

BACKGROUND OF THE INVENTION

Field of the Invention

The present invention relates to an atomizing plug assembly and an atomizer formed thereby, which is used to atomize liquid into fine droplets and may function as a distributor of essence and perfume, a humidity modifier, a skin moisturizing device, or a sprayer for dispensing fine droplets. The present invention particularly involves an atomizing plug assembly, which can be detached from the atomizer for replacing or replenishing the atomizing plug assembly, whereby the convenience of using the atomizer is promoted.

Description of the Prior Art

U.S. Pat. Nos. 7,784,712, 7,607,589, 6,805,393 and 4,533,082 disclosed an atomizer whose nozzle plate is vibrated to atomize out the liquid in a storage chamber into fine droplets. The atomizing mechanism of the atomizer comprises a nozzle plate and a vibrating member. FIG. 1 shows a conventional atomizer 1000 whose atomizing assembly 1010 and base 1100 are integrated into a single piece. The atomizing assembly 1010 is less likely or unlikely to be separated from the base 1100. While the user replenishes the atomizer 1000 with liquid, the liquid may intrude into the internal circuits or batteries and cause malfunction or current leakage. While a user intends to replace the original liquid with another liquid, he has to drain out the original liquid or even clean the liquid storage chamber 1024. Thus, moisture is very likely to intrude into the internal circuit of the atomizer 1000. The user may alternatively directly replace the original atomizer 1000 with another atomizer 1000 containing the desired liquid. However, it would increase the cost of using the atomizer 1000. Besides, while one of the components of the atomizer 1000 (such as the containing part 1020, the atomizing part 1030 or the base 1100) breaks down, it is hard to detach or repair because the atomizing assembly 1010 is integrated with the base 1100. Consequently, the cost of using the atomizer 1000 is increased.

Further, the conventional atomizer 1000 is electrically connected with the base 1100 via string type wires (not shown). However, the string type wires are more likely to be melted by the heat generated by great current and also more likely to be broken apart, so that the corresponding circuit easily suffers from risks of short circuit or break circuit. Because the string type wire has a risk to be broken/fracture, it is unsuitable to be used in detachable devices but only suitable to be used in integral devices to avoid the situation that the string type wire is pulled and dragged to break apart during disassembly.

SUMMARY OF THE INVENTION

In order to solve the problems of the conventional technology, the present invention proposes an atomizing plug assembly and an atomizer formed thereby. The atomizing plug assembly can be easily detached from the base of the atomizer, whereby the liquid that is to be atomized can be replenished or replaced conveniently; whereby the atomizing plug assembly or the base, which has malfunctioned, can be easily replaced to repair the atomizer. Further, the atomizing plug assembly is configured to be installed in an appropriate power source to form an atomizer so as to promote the convenience of using the atomizing plug assembly and the atomizer formed thereby. Besides, the atomizing plug assembly of the present invention is electrically connected with the base via a pin element so as to overcome the break-apart problem resulting from that the conventional atomizing plug assembly is connected with the base via string type wires.

In one broad aspect, there is provided an atomizing plug assembly comprising a containing part and an atomizing part. Said containing part has a containing body. Said containing body defines a containing space for receiving a liquid thereinside and has an aerosol opening on exterior thereof. Said aerosol opening communicates with said containing space. Said atomizing part is integrated with or detachably connected with said containing part. Said atomizing part includes a vibrating member, a nozzle plate and a pin element. Said vibrating member is connected with said nozzle plate and has an atomizing electrical connecting portion. Said pin element is electrically connected with said atomizing electrical connecting portion. The direction of the gravity of said liquid saved in said containing body is parallel to the installation direction of said nozzle plate. A plug portion is outwardly protruding from the bottom of said containing body, wherein said nozzle plate is located corresponding to said aerosol opening and said pin element is located corresponding to said plug portion.

Preferably, said plug portion is rotatable and said atomizing part further includes a rotatable portion rotatably and electrically connected with said atomizing electrical connecting portion. Said pin element is integrated with or detachably connected with said rotatable portion, and said pin element is electrically connected with said rotatable portion.

Preferably, there is provided an atomizer comprising said atomizing plug assembly and comprising a base. Said base includes a base body and said atomizing plug assembly is plugged into said base body. Said base body has a groove for receiving a portion of said atomizing plug assembly and a base electrical connecting portion positioned on the bottom of said groove. Said base electrical connecting portion is configured to be electrically connected with said atomizing electrical connecting portion, and said base electrical connecting portion is also electrically connected with said pin element.

Preferably, there is provided an atomizer comprising said atomizing plug assembly and comprising a base. Said base includes a base body and said atomizing plug assembly is plugged into said base body. Said base body has a groove for receiving a portion of said atomizing plug assembly and a base connecting portion positioned on the bottom of said groove. Said containing body has an installation connecting portion corresponding to said base connecting portion. Said installation connecting portion is detachably connected with said base connecting portion.

Other advantages of the present invention will become apparent from the following descriptions taken in conjunction with the accompanying drawings wherein certain embodiments of the present invention are set forth by way of illustration and examples.

BRIEF DESCRIPTION OF THE DRAWINGS

The foregoing aspects and many of the accompanying advantages of this invention will become more readily appreciated as the same becomes better understood by reference to the following detailed descriptions, when taken in conjunction with the accompanying drawings, wherein.

DESCRIPTION OF THE PREFERRED EMBODIMENT

Figure 1:
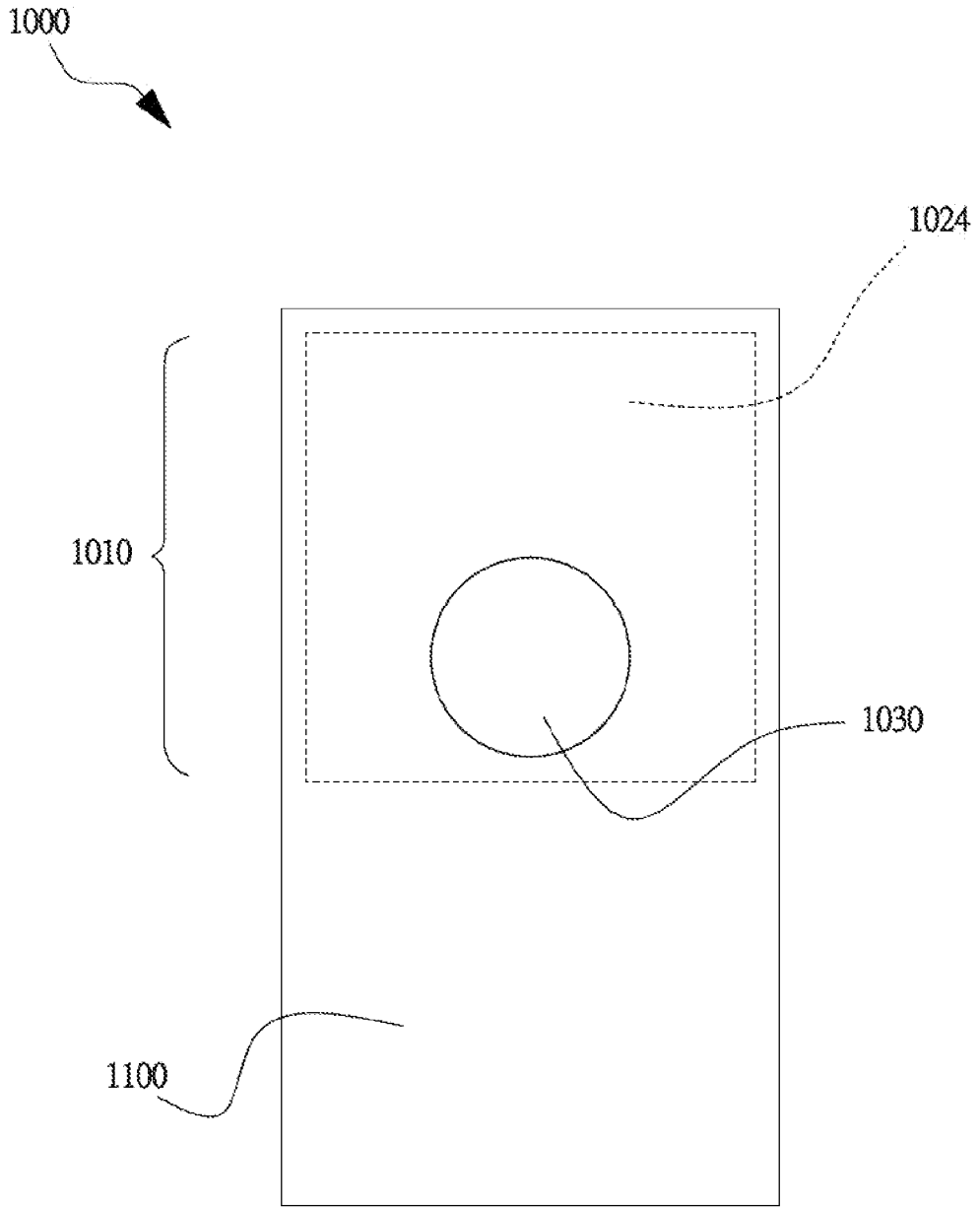
FIG. 1 is a front view schematically showing a conventional atomizer.
Figure 2:
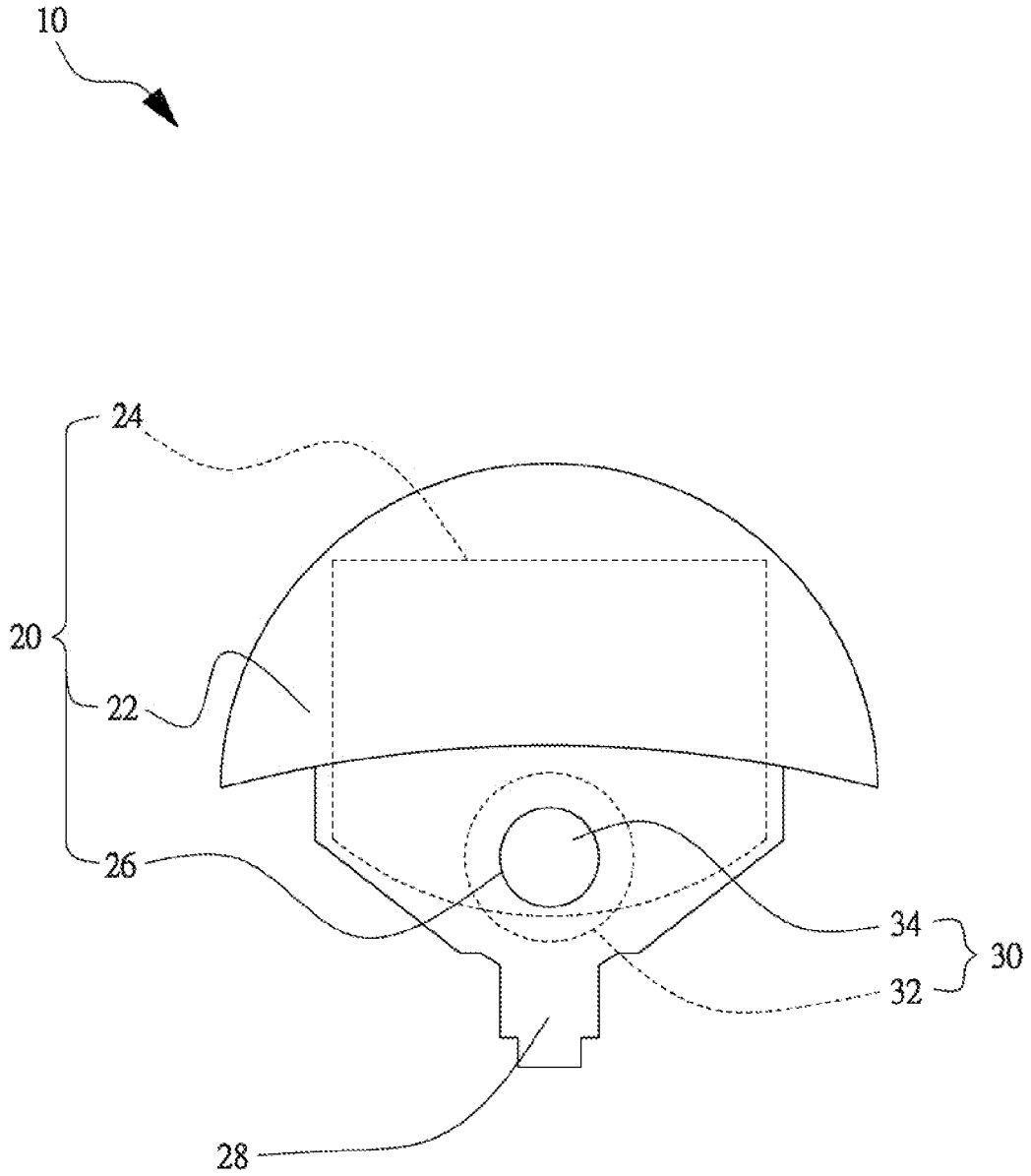
FIG. 2 is a diagram schematically showing an atomizing plug assembly according to one example of the present invention.

FIG. 2 shows an atomizing plug assembly 10 of an example of the present invention. The atomizing plug assembly 10 comprises a containing part 20 and an atomizing part 30. The atomizing part 30 is integrated with or detachably connected with the containing part 20. The containing part 20 has a containing body 22. The containing body 22 defines a containing space 24 thereinside and has an aerosol opening 26 on the exterior thereof. The aerosol opening 26 communicates with the containing space 24. The containing space 24 contains a liquid to be atomized (not shown in the drawings). The atomizing part 30 includes a vibrating member 32 and a nozzle plate 34. The vibrating member 32 or the nozzle plate 34 is connected with the containing body 22. The nozzle plate 34 is located corresponding to the aerosol opening 26. The vibrating member 32 is connected with the nozzle plate 34, whereby the liquid inside the containing space 24 is atomized into fine droplets by the nozzle plate 34, which is vibrated by the vibrating member 32 at a high frequency, and then the liquid is sprayed out. It should be noted: although the atomizing part 30 is arranged inside the containing space 24 in FIG. 2, the present invention is not limited to the configuration. In other words, the atomizing part 30 may be arranged outside the containing space 24 in some embodiments of the present invention (not shown). Preferably, the atomizing part 30 is arranged outside the containing space 24 (not shown), whereby the atomizing part 30 can be more easily detached from the containing part 20 in the case that the atomizing part 30 is detachably connected with the containing part 20. The direction of the gravity of the liquid saved in said containing body 22 is parallel to the installation direction of said nozzle plate 34 (referring to FIG. 4A in the same time). A plug portion 28 outwardly protruded from the bottom of the containing body 22, wherein the nozzle plate 34 is located corresponding to the aerosol opening 26 and the pin element 40 is located corresponding to the plug portion 28. In one embodiment, the plug portion 28 is rotatable.

Figure 3A:
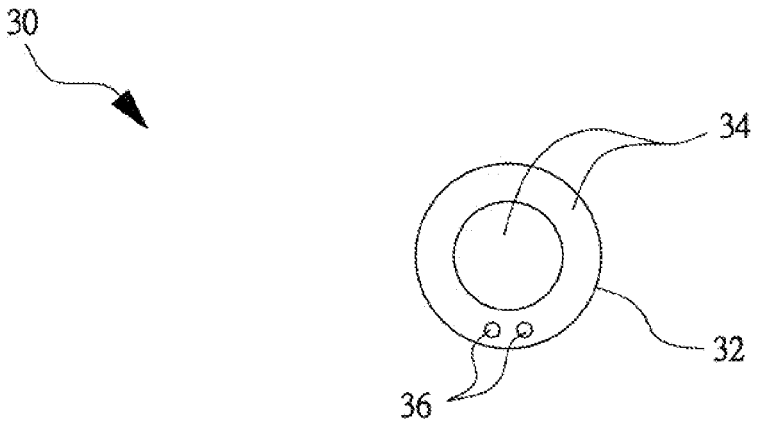
FIG. 3A is a front view schematically showing a vibrating member having an atomizing electrical connecting portion according to one example of the present invention.
Figure 3B:
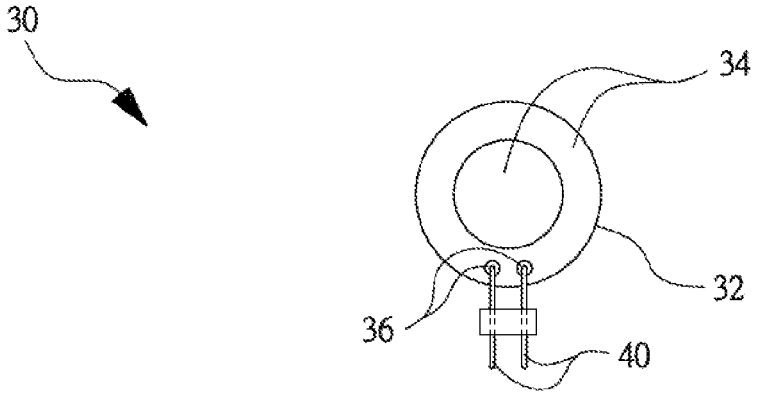
FIG. 3B is a front view schematically showing a vibrating member having an atomizing electrical connecting portion and a pin element according to one example of the present invention.
Figure 3C:
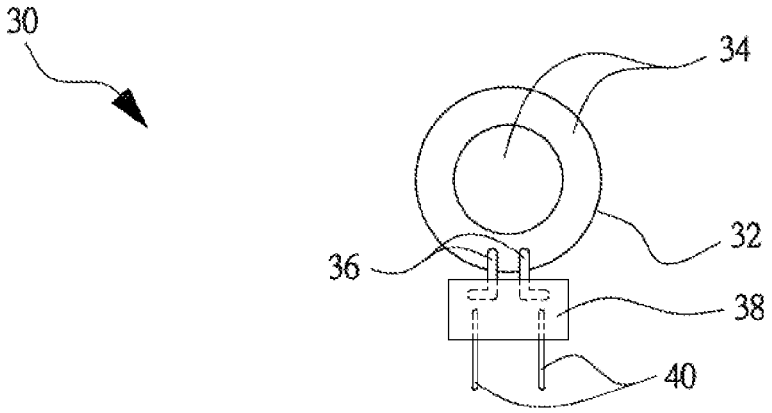
FIG. 3C is a front view schematically showing a vibrating member having an atomizing electrical connecting portion, a pin element and a rotatable portion according to one example of the present invention.

As shown in FIG. 3A, the vibrating member 32 further includes an atomizing electrical connecting portion 36, which is electrically connected with the vibrating member 32. Preferably, as shown in FIG. 3B, the atomizing part 30 further includes a pin element 40, which is integrated with or detachably connected with the atomizing electrical connecting portion 36. More preferably, as shown in FIG. 3C, the atomizing part 30 further includes a rotatable portion 38 and a pin element 40, wherein the rotatable portion 38 is rotatably and electrically connected with the atomizing electrical connecting portion 36. The pin element 40 is integrated with or detachably and electrically connected with the rotatable portion 38. The region where the rotatable portion 38 is electrically connected with the atomizing electrical connecting portion 36 is electrically connected with the region where the rotatable portion 38 is electrically connected with the pin element 40, whereby the pin element 40 is electrically connected with the atomizing electrical connecting portion 36.

Figure 4A:
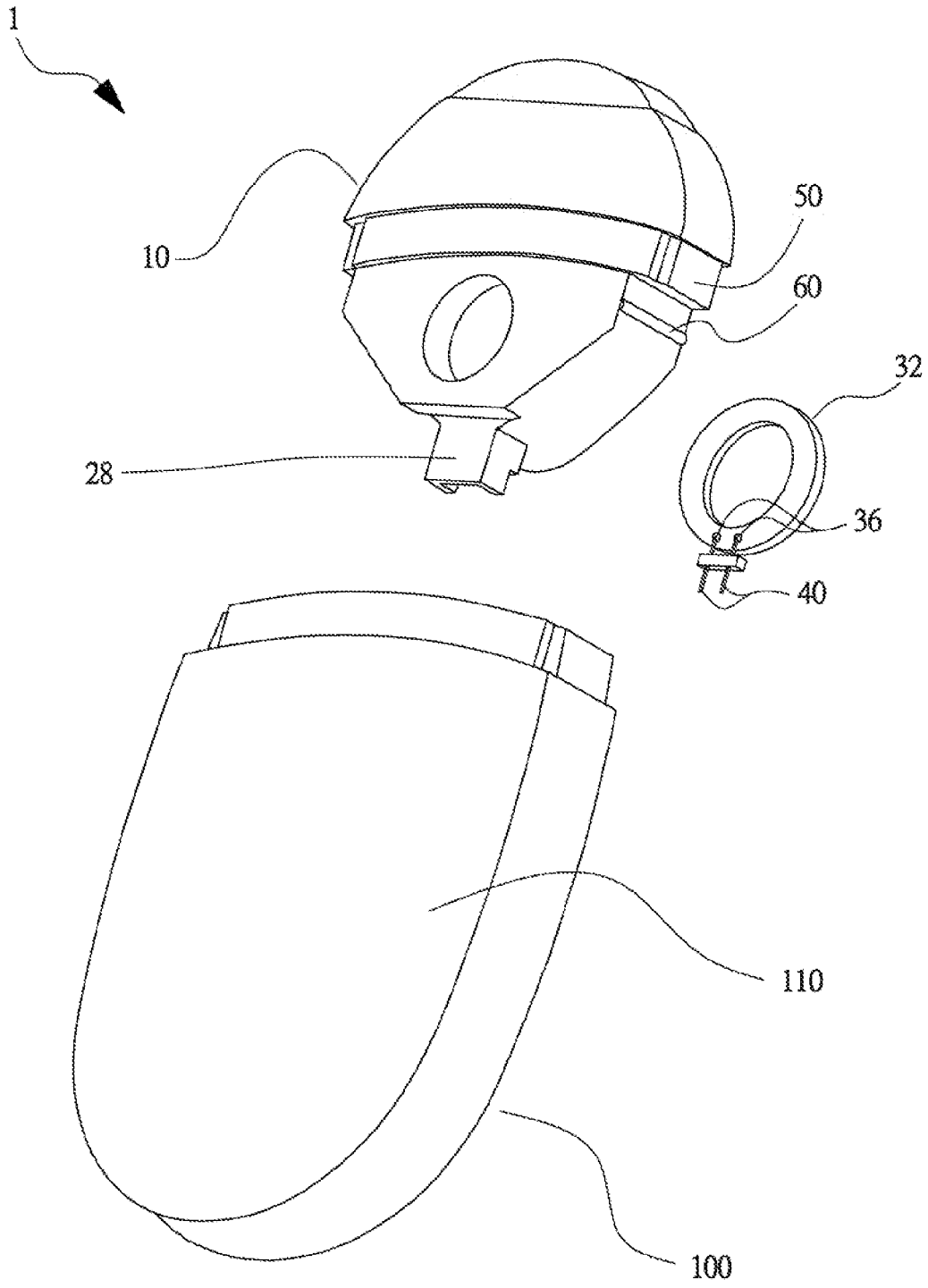
FIG. 4A is a perspective exploded view schematically showing an atomizing plug assembly and a base of an atomizer according to one example of the present invention.
Figure 4B:
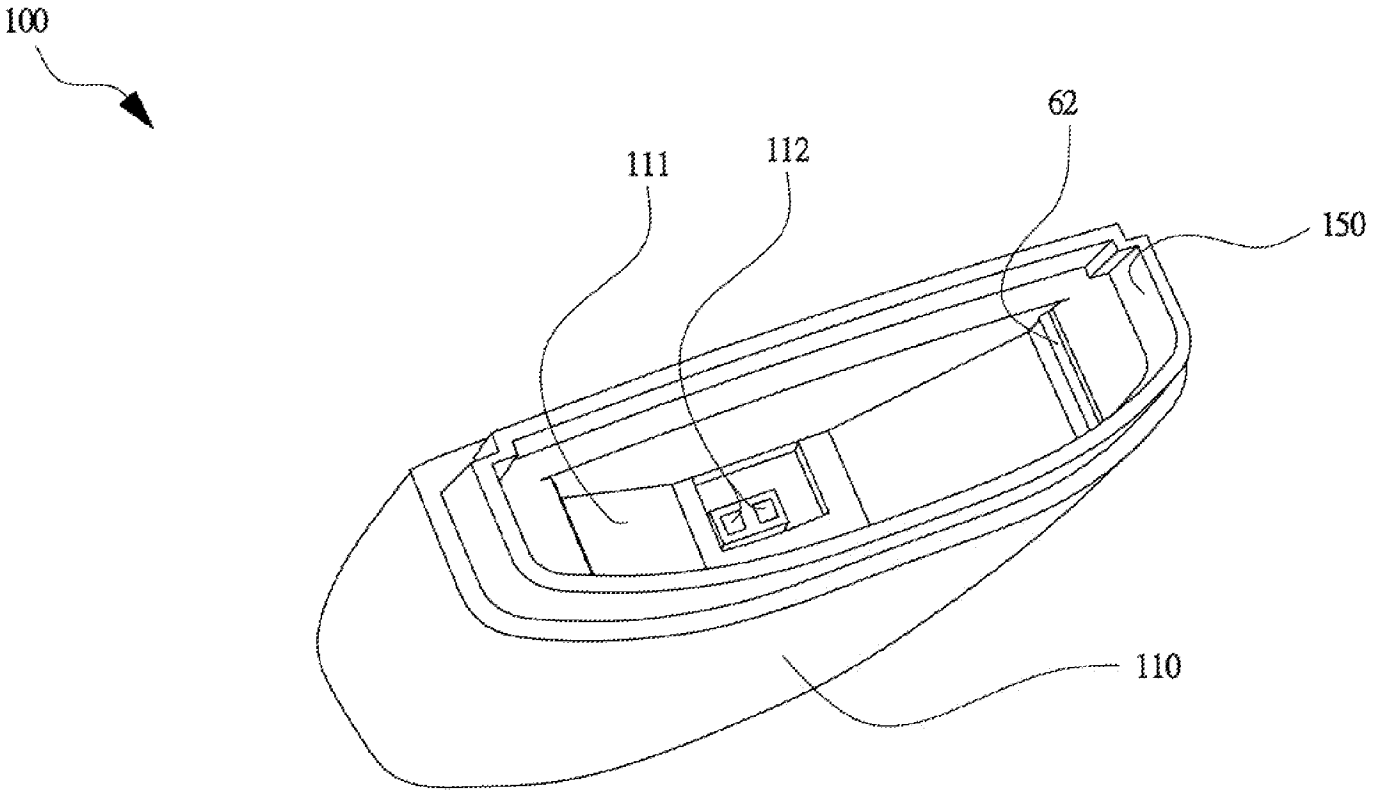
FIG. 4B is a perspective view taken from another angle and schematically showing the base shown in FIG. 4A.

Referring to FIGS. 4A-4B, a base 100 comprises a base body 110. The base body 110 has a groove 111 for receiving a portion of the atomizing plug assembly 10 and includes a base electrical connecting portion 112 positioned on the bottom of the groove 111. The base electrical connecting portion 112 is configured to be electrically connected with the atomizing electrical connecting portion 36 of the vibrating member 32. The base electrical connecting portion 112 is a power source or electrically connected with a power source. The atomizing plug assembly 10 is plugged into the base body 110 so that the electric connection of the atomizing electrical connecting portion 36 and the base electrical connecting portion 112 enables the atomizing plug assembly 10 to function as an atomizer 1. In one embodiment, the bottom of the groove 111 is upwardly-curved (as shown in FIG. 4B) to meet the shape of the atomizing plug assembly 10. In one example, the base 100 is a portable power source (such as a mobile power source bank) or a fixed-position power source (such as a fixed power socket or an extension power socket) which is provided at specific locations/positions. In one example, one end of the pin element 40 is electrically connected with one atomizing electrical connecting portion 36, and the other end of the pin element 40 is electrically connected with one base electrical connecting portion 112, whereby the atomizing electrical connecting portion 36 are electrically connected with the base electrical connecting portion 112. Wherein, the pin element 40 is detachably connected with the base electrical connecting portion 112. It should be noted that the present invention uses the pin element 40 of the atomizing part 30 of the atomizing plug assembly 10 to replace the string type wires of the conventional technology and function as an electric connection structure. The pin element 40 is made of an electric conduction material having a specified thickness. Preferably, the electric conduction material is a metallic material having a specific rigidity and strength, which can provide a sufficient structural rigidity for the connection of the atomizing plug assembly 10 and the base 100. Thus, the present invention avoids from the problems of insufficient and poor structural rigidity of the connection between the atomizing plug assembly 10 and the base 100 of the conventional technology using the string type wires as the electric connection structure. Further, in the circumstance that a mechanical connection structure is provided between the atomizing plug assembly 10 and the base 100 for enhancing the connecting structural rigidity the atomizing plug assembly 10 and the base 100, the pin element 40 can still further contribute some rigidity to the connection of the atomizing plug assembly 10 and the base 100. As the pin element 40 having a specific rigidity are used as the components of the detachable connection structure between the atomizing plug assembly 10 and the base 100, the atomizing plug assembly 10 can be easily detached from the base 100. Further, as the pin element 40 have a specific rigidity, they are less likely to be broken during detachment or assemblage, which is likely to occur in the string type wires used by the conventional technology.

Figure 5:
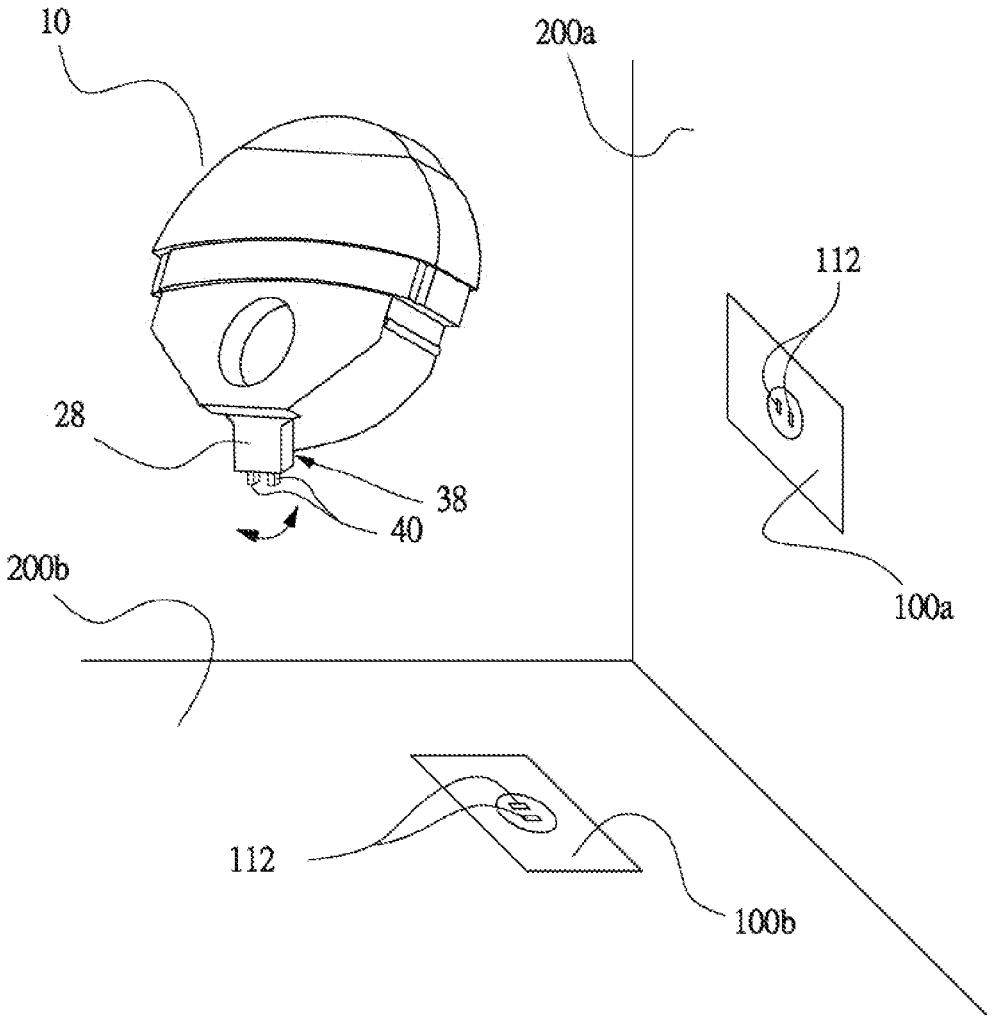
FIG. 5 is a perspective view schematically showing that a rotatable portion of an atomizing plug assembly is configured to be installed in bases respectively at different angles according to one example of the present invention.

FIG. 5 shows another example where the rotatable portion 38 (also shown in FIG. 3) can be installed in different bases 100*a* and 100*b* respectively at different angles. The base 100*a* is installed on a wall 200*a*, and the base 100*b* is installed on a ground 200*b*. The atomizing electrical connecting portion 36 are electrically connected with the base electrical connecting portion 112 via electrically connecting one end of the pin element 40 with one atomizing electrical connecting portion 36 and electrically connecting the other end of the pin element 40 with the base electrical connecting portion 112. The movement of the rotatable portion 38 enables the atomizing plug assembly 10 to be installed in the base electrical connecting portions 112 of the base 100*a* and 100*b* respectively at different angles. In other words, the atomizing plug assembly 10 can be adjusted or rotated with respect to the base 100 via the movement of the rotatable portion 38 according to requirement. In one practical example, the atomizing plug assembly 10 can be installed in the base electrical connecting portions 112 of the bases 100*a* and 100*b* respectively at different angles, maintained at an identical angle with respect to the horizontal plane by adjusting the angle/movement of the rotatable portion 38.

Referring to FIG. 4A and FIG. 4B again, the base body 110 further includes a base connecting portion 150. The containing body 22 of the containing part 20 has an installation connecting portion 50 corresponding to the base connecting portion 150, whereby the installation connecting portion 50 can be detachably connected with the base connecting portion 150. Preferably, one of the base body 110 and the atomizing plug assembly 10 has at least one protrusion 60; the other one of the base body 110 and the atomizing plug assembly 10 has at least one support portion 62 corresponding to the protrusions 60, wherein the protrusion 60 contacts the support portion 62 while the installation connecting portion 50 is connected with the base connecting portion 150, whereby to increase the contact area between the base body 110 and the atomizing plug assembly 10 and enhance the connection of the base body 110 and the atomizing plug assembly 10. Thus, the structural strength of the entire atomizer 1 is promoted, and the safety and reliability of the connection of the base body 110 and the atomizing plug assembly 10 is secured.

Under the above-mentioned configuration of the atomizing plug assembly 10 and the base 100, a user can separates the atomizing plug assembly 10 from the base 100 to replenish or replace the liquid while the liquid is used up or needs replacement so as to prevent the liquid from intruding into the base 100, especially the base electrical connecting portion 112, and damaging the base electrical connecting portion 112. Alternatively, a user can replace the original atomizing plug assembly 10 with another atomizing plug assembly 10 having the desired liquid to prevent from possible contaminations while he replenishes or replaces the liquid. In such a case, the user does not need to replace the base 100 simultaneously and thus save the cost of the base 100. Further, the required liquid is replaced quickly via this way. In another case, when the containing part 20 or atomizing part 30 is breakdown of damaged, the atomizer 1 can be functioned again by simply replacing the atomizing plug assembly 10 without changing a new atomizer 1 to save the cost.

Preferably, in the example that the containing part 20 and atomizing part 30 are configured to be detachably connected to each other, while the liquid is used up or needs replacement, a user can separate the containing part 20 from the atomizing part 30 before he replenishes or replaces the liquid so as to prevent the liquid from intruding into the atomizing part 30 or the base 100, especially the atomizing electrical connecting portion 36 or the base electrical connecting portion 112, to damage the atomizing electrical connecting portion 36 or the base electrical connecting portion 112. Alternatively, the user can directly replace the original containing part 20 with another containing part 20 having the desired liquid to prevent from possible contaminations while he replenishes or replaces the liquid; whereby the user does not need to replace the base 100 simultaneously and thus save the cost of the base 100 and the atomizing part 30, and achieves the effect of replenishing or replacing the liquid quickly. In another case, while the containing part 20 or the atomizing part 30 is breakdown or damaged, a user can only replace the damaged one of the containing part 20 and the atomizing part 30 to save the cost and satisfy the requirement of environmental protection.

It should be noted that the term "detachable connection" used in the specification refers to that each of the elements or components of the "detachable connection" has at least one connecting portion (not shown in the drawings), which enables an detachable connection, including the engaging type connection, the hooking type connection, the snap-fitting type connection, and the inserting type connection (such as the plug-and-socket type connection). However, the present invention does not limit that the "detachable connection" must be one of the above-mentioned types of connections. The "detachable connection" is the conventional technology familiar to the persons skilled in the art. Therefore, the detail thereof will not repeat herein. Owing to the "detachable connection" of the elements and components, while one of the elements or components is damaged or malfunctions, the user needn't replace the entire atomizer or the assembly containing the damaged or malfunctioning element or component but can only replace the damaged or malfunctioning element or component. Therefore, the present invention can save the cost of maintaining or repairing atomizers.

While the invention can be subject to various modifications and alternative forms, a specific example thereof has been shown in the drawings and is herein described in detail. It should be understood, however, that the invention is not to be limited to the particular form disclosed, but on the contrary, the invention is to cover all modifications, equivalents, and alternatives falling within the spirit and scope of the appended claims.

What is claimed is:

1. An atomizing plug assembly comprising:

a containing part having a containing body, wherein said containing body defines a containing space for receiving a liquid thereinside and has a aerosol opening on exterior thereof, said aerosol opening communicates with said containing space;

an atomizing part integrated with or detachably connected with said containing part, said atomizing part including a vibrating member, a nozzle plate and a pin element, wherein said vibrating member is connected with said nozzle plate and has an atomizing electrical connecting portion; said pin element is electrically connected with said atomizing electrical connecting portion; and a direction of the gravity of said liquid saved in said containing body is parallel to an installation direction of said nozzle plate; and a plug portion outwardly protruded from a bottom of said containing body, wherein said nozzle plate is located corresponding to said aerosol opening and said pin element is located corresponding to said plug portion.

2. The atomizing plug assembly according to claim 1, wherein said pin element is integrated with or detachably connected with said atomizing electrical connecting portion.

3. The atomizing plug assembly according to claim 1, wherein said plug portion is rotatable and said atomizing part further includes a rotatable portion rotatably and electrically connected with said atomizing electrical connecting portion, said pin element is integrated with or detachably connected with said rotatable portion, and said pin element is electrically connected with said rotatable portion.

4. An atomizer comprising an atomizing plug assembly according to claim 1 and comprising a base, wherein said base includes a base body, said base body has a groove for receiving a portion of said atomizing plug assembly and a base electrical connecting portion positioned on the bottom of said groove; said atomizing plug assembly is plugged into said base body and said base electrical connecting portion is configured to be electrically connected with said atomizing electrical connecting portion; and said base electrical connecting portion is also electrically connected with said pin element.

5. The atomizer according to claim 4, wherein said pin element is integrated with or detachably connected with said atomizing electrical connecting portion, and said pin element is detachably connected with said base electrical connecting portion.

6. The atomizer according to claim 4, wherein said atomizing part further includes a rotatable portion rotatably and electrically connected with said atomizing electrical connecting portion, said pin element is integrated with or detachably connected with said rotatable portion, said pin element is electrically connected with said rotatable portion, and said pin element is detachably connected with said base electrical connecting portion.

7. An atomizer comprising an atomizing plug assembly according to claim 1 and comprising a base, wherein said base includes a base body; said atomizing plug assembly is plugged into said base body; said base body has a groove for receiving a portion of said atomizing plug assembly and a base connecting portion positioned on a bottom of said groove; said containing body has an installation connecting portion corresponding to said base connecting portion; and said installation connecting portion is detachably connected with said base connecting portion.

8. The atomizer according to claim 7, wherein one of said base connecting portion and said installation connecting portion has a protrusion, another one of said base connecting portion and said installation connecting portion has a support portion corresponding to said protrusion, said protrusion contacts said support portion while said base connecting portion is connected with said installation connecting portion.

9. The atomizer according to claim 8, wherein said base body has a base electrical connecting portion, said base electrical connecting portion is electrically connected with said atomizing electrical connecting portion.

10. The atomizer according to claim 9, wherein said pin element is integrated with or detachably connected with said atomizing electrical connecting portion, said pin element is electrically and detachably connected with said base electrical connecting portion.

11. The atomizer according to claim 9, wherein said plug portion is rotatable and said atomizing part further includes a rotatable portion rotatably and electrically connected with said atomizing electrical connecting portion, said pin element is integrated with or detachably connected with said rotatable portion, said pin element is electrically connected with said rotatable portion, and said pin element is electrically and detachably connected with said base electrical connecting portion.

* * * * *